US008852354B2

(12) United States Patent
Uz et al.

(10) Patent No.: US 8,852,354 B2
(45) Date of Patent: Oct. 7, 2014

(54) DISHWASHER AND CONTROL METHOD THEREOF

(76) Inventors: Atilla Uz, Istanbul (TR); Orhan Diril, Istanbul (TR); Songul Bayraktar, Istanbul (TR)

( * ) Notice: Subject to any disclaimer, the term of this patent is extended or adjusted under 35 U.S.C. 154(b) by 1715 days.

(21) Appl. No.: 10/598,785

(22) PCT Filed: Mar. 16, 2005

(86) PCT No.: PCT/IB2005/050915

§ 371 (c)(1),
(2), (4) Date: Sep. 11, 2006

(87) PCT Pub. No.: WO2005/089621

PCT Pub. Date: Sep. 29, 2005

(65) Prior Publication Data

US 2007/0181156 A1 Aug. 9, 2007

(30) Foreign Application Priority Data

Mar. 16, 2004 (TR) ..... a 2004 00521

(51) Int. Cl.
*B08B 3/00* (2006.01)
*A47L 15/00* (2006.01)
*A47L 15/42* (2006.01)

(52) U.S. Cl.
CPC ..... *A47L 15/0049* (2013.01); *A47L 15/4297* (2013.01); *A47L 2401/08* (2013.01); *A47L 2501/05* (2013.01); *A47L 15/4225* (2013.01); *A47L 15/4202* (2013.01); *A47L 15/4208* (2013.01)
USPC ..... 134/58 D

(58) Field of Classification Search
USPC ..... 134/111
See application file for complete search history.

(56) References Cited

U.S. PATENT DOCUMENTS

| | | | | |
|---|---|---|---|---|
| 4,511,312 | A | 4/1985 | Hartwig et al. | |
| 5,340,282 | A | 8/1994 | Milocco | |
| 2003/0019510 | A1 | 1/2003 | Hegeman | |
| 2003/0103852 | A1 * | 6/2003 | Schob | 417/410.1 |
| 2005/0005952 | A1 * | 1/2005 | Bashark | 134/18 |

FOREIGN PATENT DOCUMENTS

| | | | |
|---|---|---|---|
| DE | 19630357 | A1 | 2/1998 |
| EP | 0489273 | A | 6/1992 |
| EP | 0838192 | A | 4/1998 |
| JP | 2005000511 | A * | 1/2005 |

OTHER PUBLICATIONS

Machine Translation of Sagou, JP 2005-000511A, Jan. 2005.*

* cited by examiner

*Primary Examiner* — David Cormier
(74) *Attorney, Agent, or Firm* — Venable, Campillo, Logan & Meaney, P.C.

(57) ABSTRACT

This invention relates to a dishwasher (1) and a control method thereof, where the effects influencing the washing performance negatively such as filter clogging, rotor blocking, foaming or increase in viscosity are identified by detecting the current (I) drawn by the circulation pump (4) from the network and the solution steps applied to solve this problem.

3 Claims, 2 Drawing Sheets

DISHWASHER AND CONTROL METHOD THEREOF

This invention relates to a dishwasher whose washing performance has been improved and a control method thereof.

In dishwashers, operation of the circulation pump can be affected negatively due to using conditions. For example, an increase in the viscosity of the washing water depending on the degree of dirtiness of the load and the type of dirt causes a decrease in the the pump performance, heating up of the sealing felt which consequently results in shortening of its life span. Dense dirt covering the filters and an increase in foam amount cause the pump to suck air while running. In some cases the pump may become inoperative due to wrong usages. For example solid rests like broken glass or porcelain pieces or toothpick may get into the washing water and prevent the rotation of the rotor by blocking the impeller of the circulation pump, dirty water held in the sump for a long time, hardness of washing water being very high or not using the softening system may cause the surfaces contacting each other, e.g. the pump felt of the pump to stick and this may prevent the rotation of the rotor thus causing the circulation pump to be functionless. In dishwashers, effects like increase in the viscosity of washing water, foaming, clogging of filters, sticking of the pump felt or blocking of the rotor cause an increase in noise, overloading or underloading of the circulation pump, overheating of the motor due to excessive current drawn by the pump motor, a decrease in washing performance by compressing air-water mixture and increase in energy consumption.

In the German patent embodiment No. DE 4418721, for the flow continuity and consistency of the wash solution, the pump speed is controlled using phase gate control of the driving motor and flow changes are assessed from speed or current variations of the motor in a dishwasher.

The European patent No. EP 0920591 is related to a method of that provides electronic control of working periods of the synchronous or asynchronous drain pump motors used in household appliances during loaded or unloaded working.

The object of this invention is the realization of a dishwasher and control method thereof which identifies the matters affecting the washing performance negatively, using the data of current drawn from the network and which puts problem solving steps in application by adjusting the number of revolutions of the pump motor.

Figure 1:
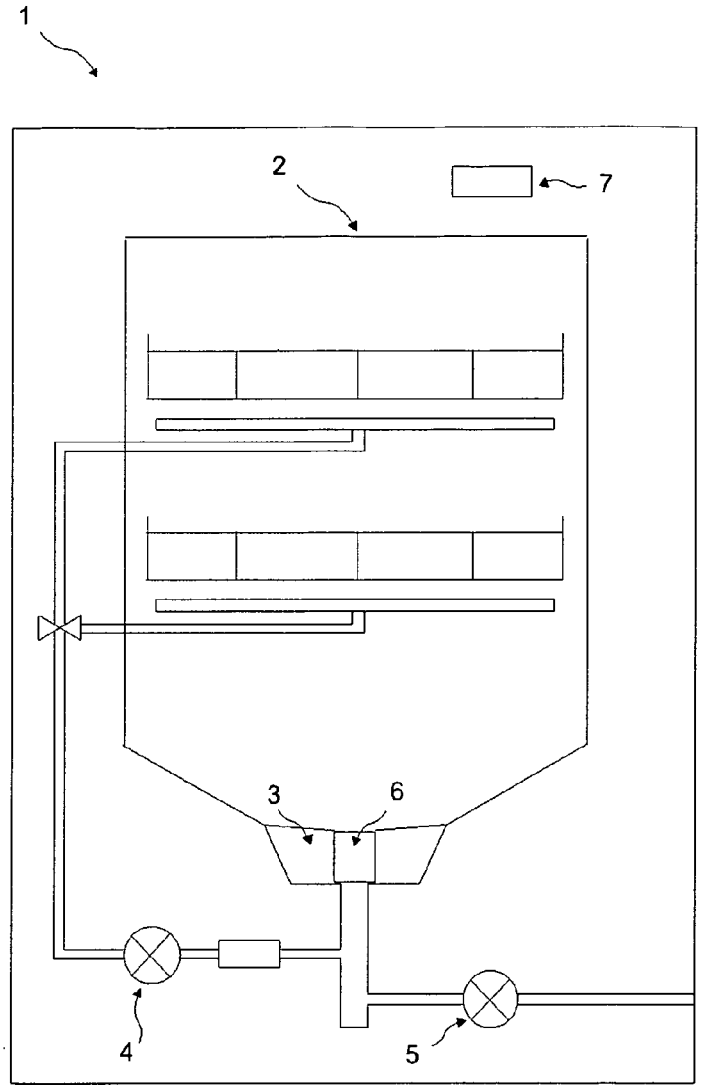

A dishwasher and control method realized to reach the object of this invention is shown in attached figures whereby, FIG. 1—is the schematic view of a dishwasher.

FIGS. 2 to 8—are the current-time graphs showing the time-based variation of the current drawn by a circulation pump motor of a dishwasher from the network.

Elements shown in figures are numbered as follows.

1. Dishwasher
2. Wash tub
3. Sump
4. Circulation pump
5. Drain pump
6. Filter
7. Control card The dishwasher (1) comprises a wash tub (2) in which the dishes to be washed are placed, a sump (3) which is in the lower section of the wash tub (2), where during washing operation the water present in the wash tub (2) is collected, a circulation pump (4) turning the water in the sump (3) back to the wash tub (2), driven by an electric motor with variable rpm, a drain pump (5) which drains the water collected in the sump (3) at the end of the washing operation out of the dishwasher (1), a filter (6) preventing the dirt particles from get into circulation during washing and thus decreasing the effectiveness of washing and a control card (7) that senses the variations of current (I) drawn by the circulation pump (4) from the network and controls its operation.

In the dishwasher (1) which is object of the present invention, the control card (7) tracing the current (I) drawn by the circulation pump (4) from the network, determines the effects such as clogging of the filter (6), increase in viscosity or amount of foam in washing water, blocking of rotor thus preventing the operation of the circulation pump (4) or sticking of the pump felt that influence the washing performance negatively and cause noise, and the identified problem is solved by changing the rpm of the circulation pump (4) and/or its direction of rotation.

Figure 2:
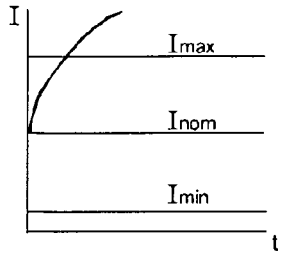

When it is determined by the control card (7) that the current (I) drawn by the circulation pump (4) from the network suddenly increases and exceeds a limit current value (Imax) or that the motor stops completely, it is concluded that the rotor is blocked or its rotation is disturbed due to sticking of the pump felt or jamming of a solid piece (FIG. 2).

After it is determined that the the rotor is blocked or rotation is disturbed, in order to solve this problem, with the start-up current (Io) enabling the circulation pump (4) to shift from the inoperative phase to the operating phase, in the positive rotation direction, start-up attempts at a predetermined number (n) and by increasing the torque with a current higher than the start-up current (Io), in the positive rotation direction, n start-up attempts are performed; if no success is obtained, with the start-up current (Io) n start-up attempts in the negative rotation direction and by increasing the torque with a current higher than the start-up current (Io) n start-up attempts in the negative rotation direction are performed. If the problem is not solved, the operation of the dishwasher (1) is stopped.

Figure 3:
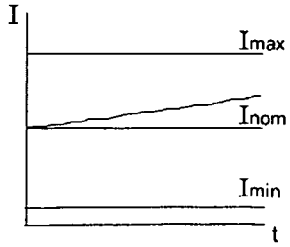

When the increasing change of the current (I) drawn by the circulation pump (4) from the network with respect to nominal current (Inom) is observed by the control card (7), it is decided that the dirt and oil getting into the washing water increases the viscosity of the washing water and therefore the circulation pump (4) is forced to increase the amount of the current (I) drawn gradually to meet the increasing load. If the gradually increasing current (I) exceeds a certain limit current value (Imax), it is determined that the washing water is not suitable (FIG. 3).

After it is decided that the viscosity of the washing water is increased, the circulation pump (4) is continued to operate at low rpm. to solve this problem. Meanwhile, if according to the variation of the current (I) amount, it is determined that the washing water is not suitable, the washing water is drained and clean water is taken.

Figure 4:
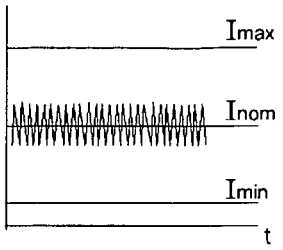
Figure 5:
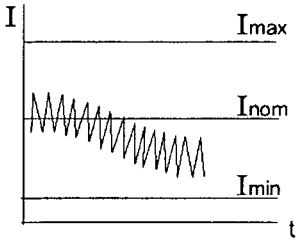
Figure 6:
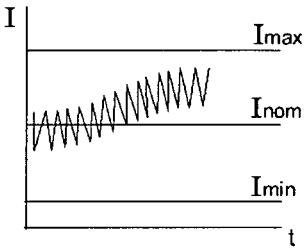
Figure 7:
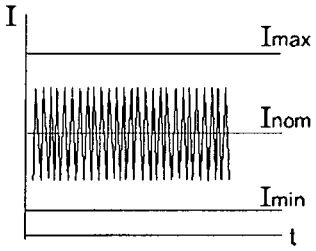

When it is detected by the control card (7) that the current (I) drawn by the circulation pump (4) from the network fluctuates within a proper range, it is concluded that the filter (6) in the sump (3) is partly clogged and therefore the circulation pump (4) sucks air-water mixture (FIG. 4).

When the decision of partial filter (6) clogging is taken, some water is taken into the sump (3), the washing operation is continued by lowering the rpm of the circulation pump (4) down to a point where it can operate without absorbing air.

When it is detected by the control card (7) that the current (I) drawn by the circulation pump (4) from the network fluctuates within an interval gradually decreasing (FIG. 5) or increasing (FIG. 6) with respect to nominal current (Inom), or when waves with greater amplitudes (FIG. 7) compared with partial filter (6) clogging are observed, it is concluded that the amount of foam in the washing water prevents the circulation pump (4) from proper operation.

When foaming effect is determined, the rpm of the circulation pump (4) is decreased until the current fluctuations are lowered to a preset level and thus it is provided that the foam remains in the sump (3) above the sucking level of the circulation pump (4) and washing operation is continued with the circulation pump (4) sucking enough water.

Figure 8:
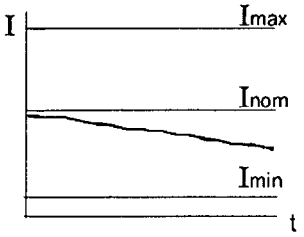

When a decreasing change of the current (I) drawn by the circulation pump (4) from the network with respect to nominal current (Inom) is detected by the control card (7), it is concluded that the filter (6) is clogged completely, the water level in the sump (3) has decreased since the washing water can not pass to the sump (3) and that the load coming to the circulation pump (4) has decreased (FIG. 8).

When it is decided that the filter (6) is clogged completely, some water is taken into the dishwasher (1) and the rpm of the circulation pump (4) is decreased and the normal washing operation is continued. Meanwhile by observing the change of the current (I), if it is determined that the drawn current (I) does not return to normal, it is concluded that the filter (6) can not be cleaned in the normal cycle and the water is drained completely, clean water is taken, is led through the filter (6) and thus the filter (6) is washed and the water is drained.

In the dishwasher (1) and the control method thereof which is the object of the present invention, the current data provide the information whether the operation of the circulation pump (4) has any problem or not and, the identified problem is solved by making use of the specific characteristic of changing its rpm and/or direction of rotation of the circulation pump (4). Thus continuity in washing performance, improvement in the noise level during washing and energy saving is obtained.

An embodiment of a dishwasher (1) comprising a wash tub (2) in which the dishes to be washed is placed, a sump (3) which is in the lower section of the wash tub (2), where the water present in the wash tub (2) is collected during washing operation, a circulation pump (4), driven by an electric motor with variable rpm, turning the water in the sump (3) back to the wash tub (2), a drain pump (5) which drains the water collected in the sump (3) at the end of the washing operation out of the dishwasher (1) and a filter (6) preventing the dirt from getting into the circulation during washing and thus decreasing the effectiveness of washing, characterized by a control card (7), tracing the change of the current (I) drawn by the circulation pump (4) from the network, determines the effects such as rotor blocking, pump felt sticking, filter (6) clogging and increase of the viscosity or the amount of foam in the washing water that influence the washing performance negatively, and provides the solution by changing the rpm and/or direction of rotation of the circulation pump (4).

An embodiment of a control method for a dishwasher (1) as in additionally comprising the steps of determining that the rotor is blocked or its rotation is disturbed due to sticking of the pump felt or jamming of a solid piece when it is determined by the control card (7) that the current (I) drawn by the circulation pump (4) from the network suddenly increases and exceeds a limit current value (Imax) or that the motor stops completely, in order to solve this problem, with the start-up current (Io) enabling the circulation pump (4) to shift from inoperative position to the operating position making start-up attempts of a previously specified number (n) in the positive rotation direction and making n start-up attempts in the positive rotation direction by increasing the torque with a current higher than the start-up current (Io), if no success is obtained, making n start-up attempts in the negative rotation direction with the start-up current (Io) and making n start-up attempts in the negative rotation direction by increasing the torque with a current higher than the start-up current (Io).

An embodiment of a control method for a dishwasher (1) additionally comprising the steps of deciding that the dirt and oil getting into the washing water increases the viscosity of the washing water when the increasing deviation of the current (I) drawn by the circulation pump (4) from the network with respect to nominal current (Inom) is observed by the control card (7), deciding that the washing water is not suitable if the gradually increasing current (I) exceeds a certain limit current value (Imax), letting the circulation pump (4) continue its operation at low rpm after it is decided that the viscosity of the washing water is increased, draining the washing water and taking clean water if it is decided that the washing water is not suitable according to the variation of the current (I) amount.

An embodiment of a control method for a dishwasher (1) additionally comprising the steps of deciding that the filter (6) in the sump (3) is partly clogged and the circulation pump (4) sucks air-water mixture when it is detected by the control card (7) that the current (I) drawn by the circulation pump (4) from the network fluctuates within a proper range, taking some water into the sump (3), lowering the rpm of the circulation pump (4) until the value where it can operate without absorbing air and continuing with the washing operation.

An embodiment of a control method for a dishwasher (1) additionally comprising the steps of deciding that the amount of foam in the washing water prevents the circulation pump (4) from proper operation when it is detected by the control card (7) that the current (I) drawn by the circulation pump (4) from the network fluctuates within an interval gradually decreasing or increasing, or when waves with high amplitudes are observed, decreasing the rpm of the circulation pump (4) until the current fluctuations are lowered to a preset level and thus it is provided that the foam remains above the sucking level of the circulation pump (4) in the sump (3) and continuing of the washing operation with the circulation pump (4) sucking enough water.

An embodiment of a control method for a dishwasher (1) additionally comprising the steps of deciding that the filter (6) is clogged completely and the water level in the sump (3) has decreased since the washing water can not pass to the sump (3), when a decreasing change of the current (I) drawn by the circulation pump (4) from the network with respect to nominal current (Inom) is detected by the control card (7), taking some water into the dishwasher (1) and lowering the rpm of the circulation pump (4) and continuing with the normal washing operation, deciding that the filter (6) can not be cleaned in the normal cycle if it is determined that the drawn current (I) does not return to normal, draining the water completely, taking clean water and making it pass through the filter (6) thus washing the filter (6) and draining the water.

The invention claimed is:

1. A dishwasher for determining rotor blocking, pump felt sticking, filter clogging, increase of a viscosity or an amount of foam in a washing water that influences washing performance negatively, comprising a wash tub in which dishes to be washed are placed, a sump which is in a lower section of the wash tub, where the water present in the wash tub is collected during a washing operation, a circulation pump, driven by an electric motor with variable rpm and changeable direction of rotation, turning the water in the sump back to the wash tub, a drain pump for draining the water collected in the sump at the end of the washing operation out of the dishwasher and a filter for preventing dirt from getting into circulation during washing, and a control card, tracing a change of a current (I) drawn by the circulation pump from a network to change an rpm and/or direction of rotation of the circulation pump and wherein the control card further comprises a control method comprising the steps of:

detecting that the current (I) drawn by the circulation pump from the network is fluctuating and is gradually decreasing or increasing with respect to a nominal current (Inom), decreasing the rpm of the circulation pump to lower the current fluctuations to a preset level such that the foam remains above a sucking level of the circulation pump in the sump and continuing of the washing operation with the circulation pump having enough water.

2. A dishwasher for determining rotor blocking, pump felt sticking, filter clogging, increase of a viscosity or an amount of foam in a washing water that influences the washing performance negatively, comprising a wash tub in which dishes to be washed are placed, a sump which is in a lower section of the wash tub, where the water present in the wash tub is collected during washing operation, a circulation pump, driven by an electric motor with variable rpm and changeable direction of rotation, turning the water in the sump back to the wash tub, a drain pump for draining the water collected in the sump at the end of the washing operation out of the dishwasher and a filter for preventing dirt from getting into circulation during washing, and a control card, tracing a change of a current (I) drawn by the circulation pump from a network to change an rpm and/or direction of rotation of the circulation pump and wherein the control card further comprises a control method of determining if the amount of foam in the washing water prevents the circulation pump from proper operation comprising the steps of:

detecting that the current (I) drawn by the circulation pump from the network fluctuates within a current limit proper range below Imax, taking some water into the sump, lowering the rpm of the circulation pump until a value where it can operate without absorbing air and continuing with the washing operation and detecting that the current (I) drawn by the circulation pump from the network is fluctuating and is gradually decreasing or increasing with respect to a nominal current (Inom), and decreasing the rpm of the circulation pump to lower the current fluctuations to a preset level such that the foam remains above a sucking level of the circulation pump in the sump and continuing of the washing operation with the circulation pump having enough water.

3. A dishwasher for determining rotor blocking, pump felt sticking, filter clogging, increase of a viscosity or an amount of foam in a washing water that influences washing performance negatively, comprising a wash tub in which dishes to be washed are placed, a sump which is in a lower section of the wash tub, where the water present in the wash tub is collected during a washing operation, a circulation pump, driven by an electric motor with variable rpm and changeable direction of rotation, turning the water in the sump back to the wash tub, a drain pump for draining the water collected in the sump at the end of the washing operation out of the dishwasher and a filter for preventing dirt from getting into circulation during washing, and a control card, tracing a change of a current (I) drawn by the circulation pump from a network to change an rpm and/or direction of rotation of the circulation pump and wherein the control card further comprises a control method comprising the steps of:

detecting that the current (I) drawn by the circulation pump from the network fluctuates within a current limit proper range below Imax, taking some water into the sump, lowering the rpm of the circulation pump until a value where it can operate without absorbing air and continuing with the washing operation and detecting that the current (I) drawn by the circulation pump from the network is fluctuating and is gradually decreasing or increasing with respect to a nominal current (Inom), decreasing the rpm of the circulation pump to lower the current fluctuations to a preset level such that the foam remains above a sucking level of the circulation pump in the sump and continuing of the washing operation with the circulation pump having enough water.

* * * * *